US005901414A

United States Patent [19]

VanHuis et al.

[11] Patent Number: 5,901,414

[45] Date of Patent: May 11, 1999

[54] STUD-PINTLE ASSEMBLY FOR BAIL STOP

[75] Inventors: David VanHuis, Marne; Kevin Todd Dewald, Spring Lake, both of Mich.

[73] Assignee: Keeler Brass Company, Grand Rapids, Mich.

[21] Appl. No.: 08/946,772

[22] Filed: Oct. 8, 1997

[51] Int. Cl.[6] ..... A47B 95/02

[52] U.S. Cl. ..... 16/126; 16/112

[58] Field of Search ..... 16/126, 112, 125, 16/124, 127

[56] References Cited

U.S. PATENT DOCUMENTS

| | | | |
|---|---|---|---|
| 2,594,027 | 4/1952 | Jakeway | 16/126 |
| 2,701,114 | 2/1955 | Donaldson | 16/126 |
| 3,673,634 | 7/1972 | Van Ryn et al. | 16/126 |
| 3,769,655 | 11/1973 | Cartwright | 16/126 |
| 4,261,077 | 4/1981 | Brock et al. | 16/126 |
| 5,461,755 | 10/1995 | Hardigg et al. | 16/112 |

*Primary Examiner*—Chuck Y. Mah

*Attorney, Agent, or Firm*—Rader, Fishman & Grauer PLLC

[57] ABSTRACT

A stud-bail assembly is made of a bail with pintles each having a recessed portion which mates with studs having boss portions to create a limiting structure to restrict the swinging movement of the bail, thus preventing the bail from damaging the underlying surface of the assembly. Additionally, the stud-bail assembly is formed as a one-piece part to facilitate ease of shipping and handling.

4 Claims, 4 Drawing Sheets

STUD-PINTLE ASSEMBLY FOR BAIL STOP

FIELD OF INVENTION

The present invention relates to a stud and bail attachment assembly. More particularly, the present invention is directed to a stud and bail assembly that utilizes a limiting design to restrict the movement of a bail to insure protection of the surface on which the bail assembly is mounted as well as facilitate easier handlability by forming a one-piece part.

BACKGROUND OF THE INVENTION

A stud and bail assembly is used most often as a handle to open drawers, cabinet doors, or the like. Usually, a combination of studs, rosettes, and a bail are used. A pair of studs are placed on the pintles of a bail, and a rosette is placed on each stud. This assembly is then mounted onto the face of a surface such as a drawer and locked into place usually by a pair of screws. It is also known to substitute the rosettes with a decorative backplate with holes to accommodate the studs. This assembly is then attached to the face of a surface such as a drawer to form a handle.

In a typical stud-bail assembly, the bail is left to swing freely because the stud-pintle assembly forms a rotational joint. This swinging action allows the bail to impact the mounted surface causing damage to the finish of the contacting surface or backplate. Therefore, stops are required on the bails to restrict the bail from making contact with the underling surface to prevent damage. Typically, stops are formed on the underside of the bail to prevent the bail from swinging down onto the mounted surface. However, this stop configuration does not prevent the bail from swinging upwards to hit the mounted surface or backplate at the top of where the bail assembly is mounted. Furthermore, the stops themselves can cause minor damage to the rosettes, backplate, or the underling surface after repeated impact.

Another problem with known stud-bail assemblies is shipping and handling. Typically, the studs and rosettes are held on the pintles of the bail with rubberbands during shipping or the pieces are shipped as loose components that require assembly during mounting. Handling many individual components, whether loose or held together by rubberbands, poses disadvantages such as increasing the chance of missing parts, longer assembly time, and more complex inventory.

SUMMARY OF THE INVENTION

A stud-bail assembly of the present invention comprises a bail, studs, and rosettes all assembled together as one piece. Because the assembly is reduced to a one-piece part, no pieces will be lost during shipping and handling. Furthermore, mounting to a surface is simplified since assembly of all the pieces during mounting is eliminated.

Additionally, the stud-bail assembly of the present invention comprises a bail with pintles having a recessed portion and a pair of studs having a boss portion. When assembled, the recessed portion of the pintles couple with the bossed portion of the studs to form a limited structure to restrict the swinging movement of the bail. The created structure eliminates the need for stops on the bail to prevent the bail from contacting the mounted surface or a backplate. Furthermore, the created structure restricts both the upward swing as well as the downward swing, effectively preventing the bail from contating the mounted surface or the backplate in both directions. Therefore, the mounted surface or backplate is protected from any kind of damage caused by an impacting bail since the bail never comes in contact with the mounted surface.

BRIEF DESCRIPTION OF DRAWINGS

The features and inventive aspects of the present invention will become more apparent upon reading the following detailed description, claims, and drawings, of which the following is a brief description:

DETAILED DESCRIPTION OF THE INVENTION

Figure 1:
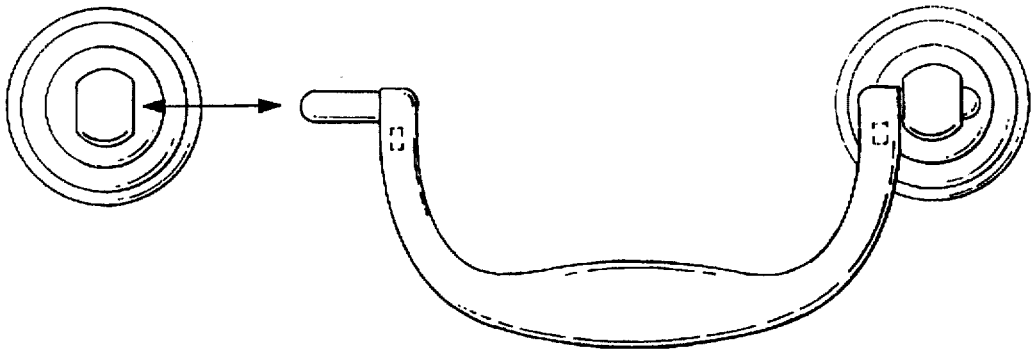
(PRIOR ART) FIG. 1
FIG. 1 is a view of a prior art stud-bail assembly.
Figure 2:
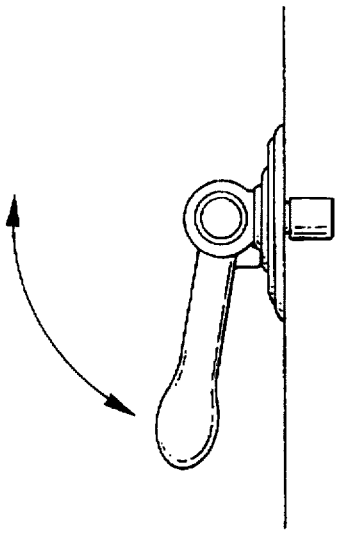
(PRIOR ART) FIG. 2
FIG. 2 is a side view of a prior art stud-bail assembly.

FIGS. 1 and 2 show a well known stud-bail assembly. As shown in FIG. 1, bail 20 is formed with pintles 22 and stops 24. Pintles 22 are inserted into respective studs 26. Typically, studs 26 are coupled with rosettes 28 and attached to a mounting surface. As apparent from the figure, each component needs to be assembled prior to mounting. As shown in FIG. 2, the stud-bail assembly of the prior art allows bail 20 to swing freely. Therefore, stops 24 are required to prevent bail 20 from impacting mounted surface 30 on a downward swing. However, as apparent from the figure, the repeated impact from stops 24 on rosettes 28 may cause unwanted damage to rosettes 28. Furthermore, there is nothing to prevent bail 24 from swinging upwards and damaging surface 30 above the mounted assembly.

Figure 3:
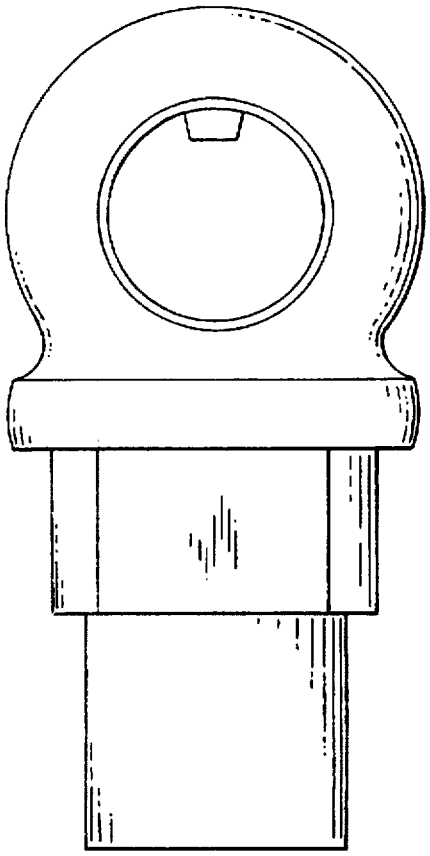
FIG. 3 is a view of a stud of the present invention.
Figure 4:
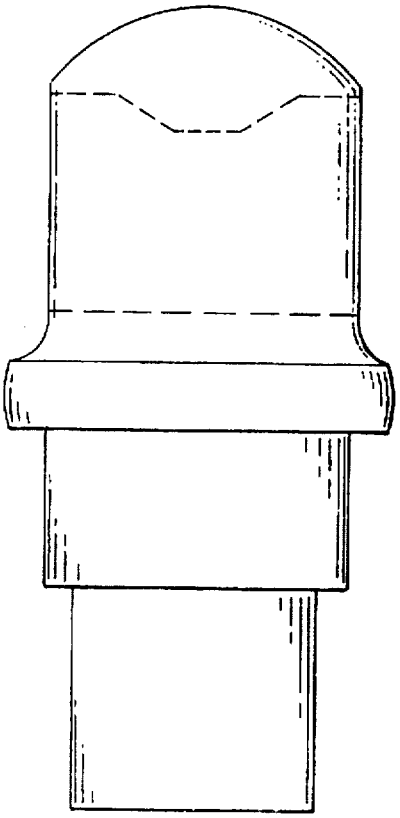
FIG. 4 is a rotated view of FIG. 3.

FIGS. 3 and 4 show a stud of the present invention. Stud 40 has a head section 42, a mid section 44, and a bottom section 46. The mid section 44 is fashioned to receive an opening such as from rosette 28 of FIG. 1 or backplate 68 of FIG. 10. The bottom section 46 is constructed to receive a screw (not shown) or any suitable fastener to attach stud 40 to a mounting surface. The head section 42 has an opening 48 fashioned to receive a pintle. A boss portion 50 is formed on the inside of opening 48. The distance from the bottom of opening 48 to the tip of boss portion 50 is wide enough to allow a pintle to clear past boss 50.

Figure 5:
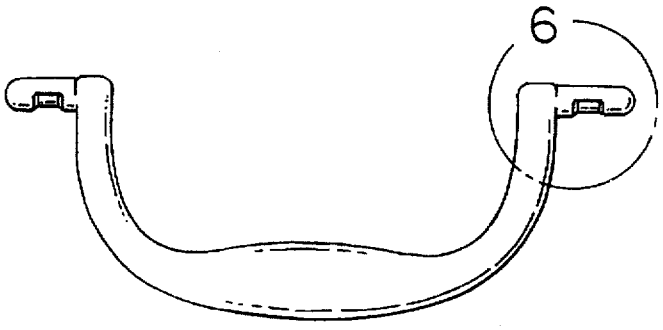
FIG. 5 is a view of a bail of the present invention.
Figure 7:
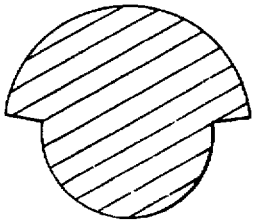
FIG. 7 is a cross-sectional view of a pintle along 7—7 of FIG. 6.
Figure 6:
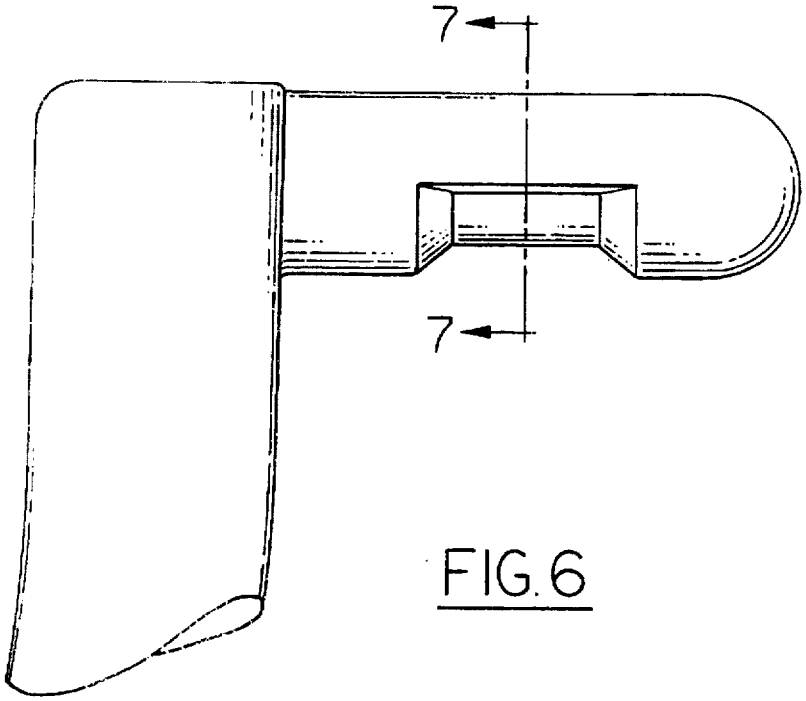
FIG. 6 is a detailed view of a pintle of the present invention.

FIG. 5 shows a bail of the present invention. Bail 52 has pintles 54 on either side. Referring to a more detailed view of pintle 54 as shown in FIG. 6, pintle 54 has a recessed portion 56. Recessed portion 56 is defined by sides 60, 62, 64, and 66. (see also FIG. 7)

Figure 9:
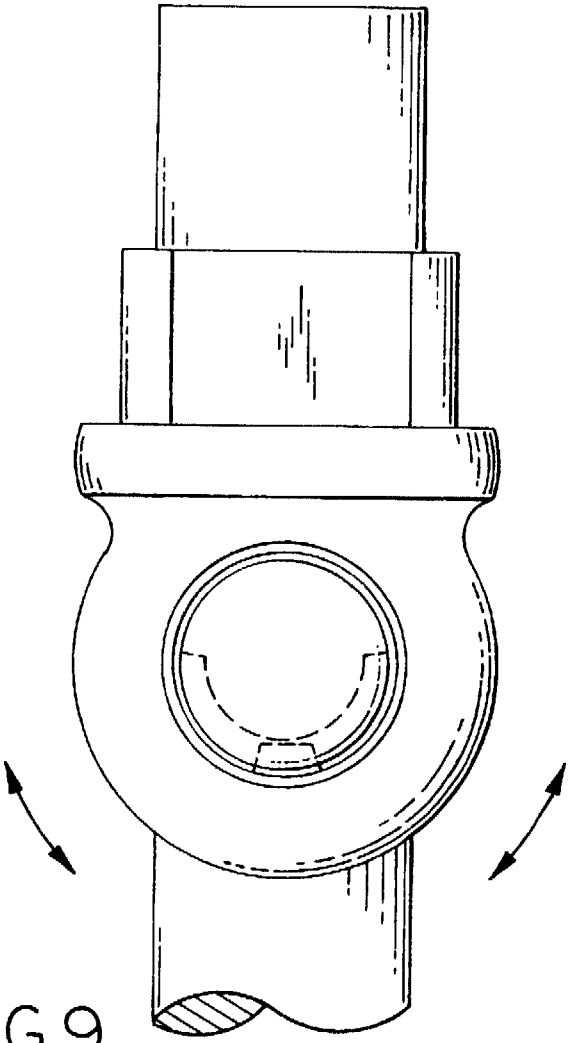
FIG. 9 is a rotated view of FIG. 8.
Figure 8:
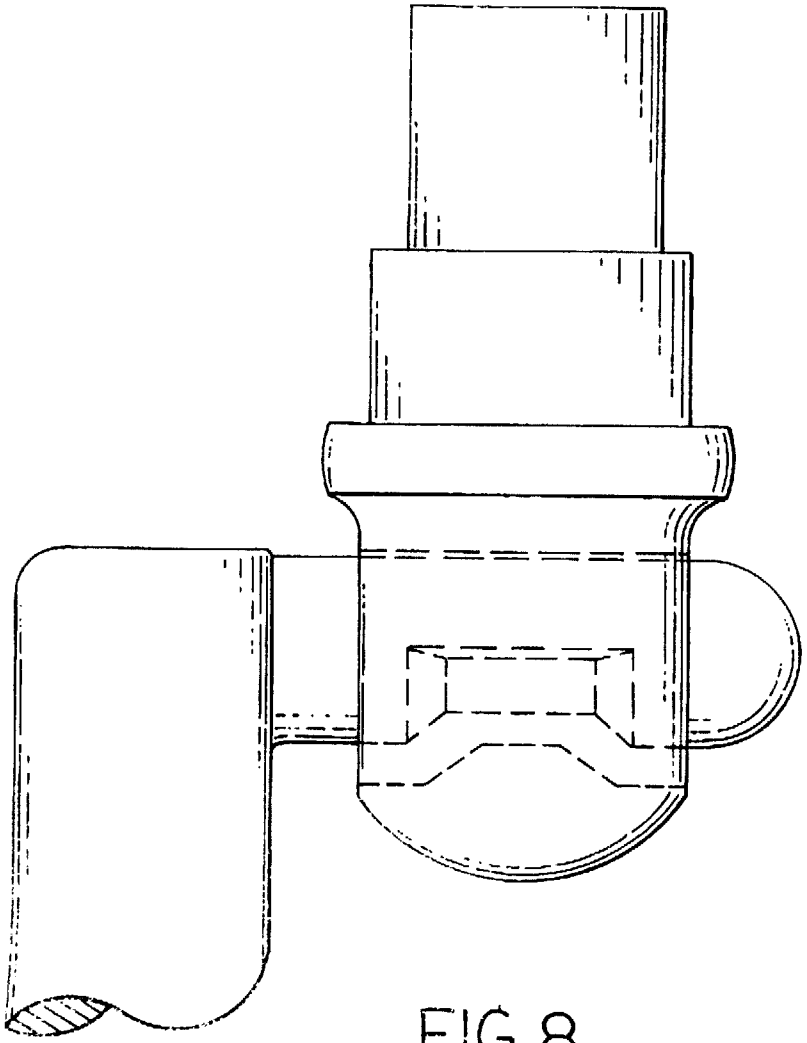
FIG. 8 is a view of a stud-pintle assembly of the present invention.

As shown in FIG. 8, bail 52 is coupled to stud 40 by inserting pintle 54 into opening 48 on the head section 42. Once recessed portion 56 is aligned with boss portion 50, head section 42 is mechanically deformed, forcing boss portion 50 to move into recessed portion 56. Accordingly, boss portion 50 is received in the recessed portion 56 of pintle 54 locking stud 40 to pintle 54. Furthermore, engagement of boss portion 50 and recessed portion 56 creates a limiting stop mechanism. As shown in rotated view FIG. 9, when bail 52 rotates clockwise, boss portion 54 contacts side 62 of recessed portion 56, thus preventing further rotational movement. Similarly, when bail 52 rotates counterclockwise, boss portion 54 contacts side 66 of recessed portion 56, preventing further rotation. Additionally, the created structure causes recessed portions 56 of pintles 54 to be held in place by boss portion 50 of studs 40, thus creating a rotatable attachment. Since the engagement of boss portion 50 and recessed portion 56 does not allow pintles 54 to slip out of studs 40, a one-piece stud-bail assembly is formed that facilitates ease of shipping and handling.

Figure 10:
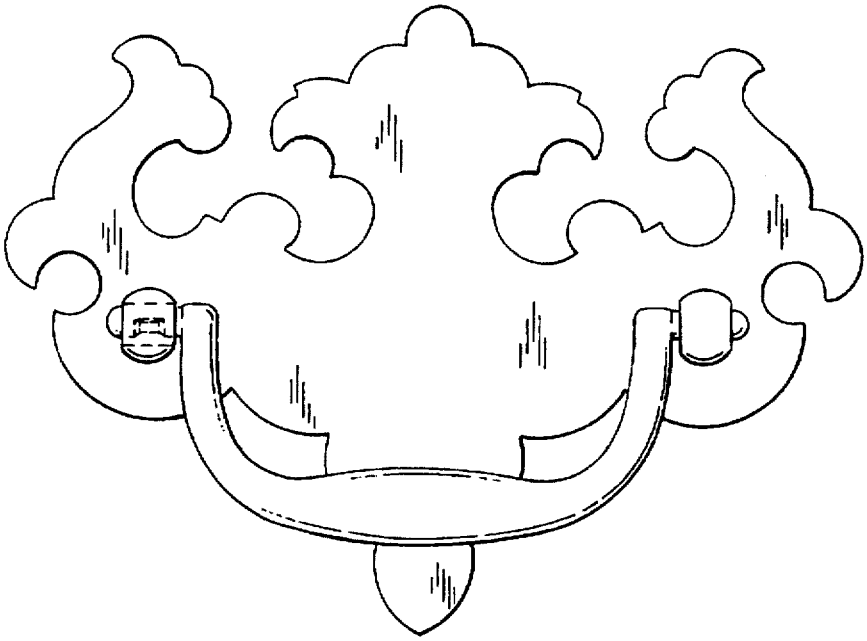
FIG. 10 is a view of a completely assembled stud-bail assembly of the present invention.

FIG. 10 shows a completed stud-bail assembly of the present invention. Bail 52 and studs 40 are made out of metal such as die cast zinc, die cast brass, or forged brass, but any suitable process may be used with any suitable material known in the art. This particular embodiment shows a stud-bail assembly using backplate 68. However, backplate 68 may be substituted with rosettes 28 as shown in FIG. 1, or any other suitable replacement known in the art. If rosettes 28 are used, for example, mid section 44 of studs 40 engages each rosette 28 and are fixedly attached by well known processes in the art such as spinning or staking to insure a one-piece part.

Figure 11:
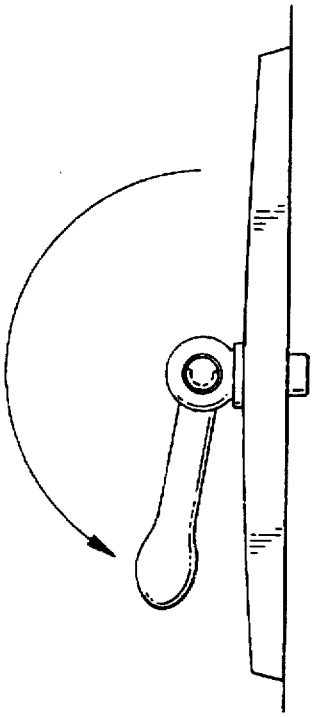
FIG. 11 is a view of a bail in a downward swing.
Figure 12:
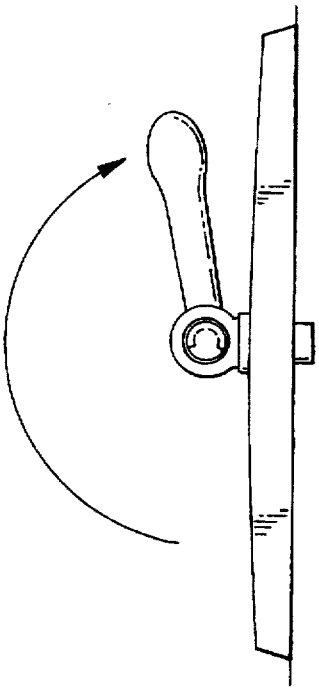
FIG. 12 is a view of a bail in an upward swing.
Figure 1:
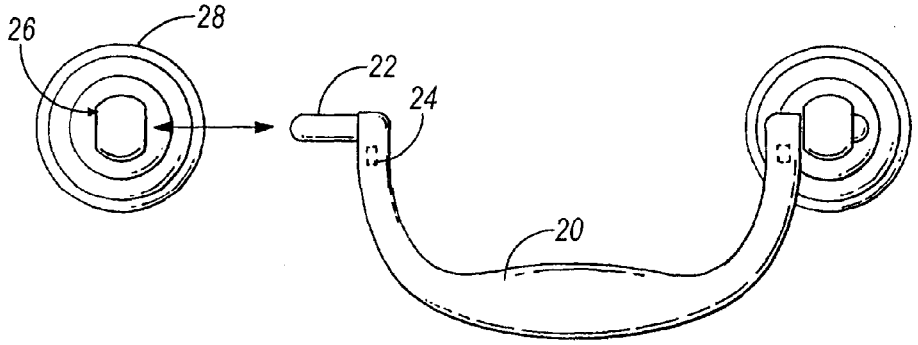
(PRIOR ART) FIG. 1
Figure 2:
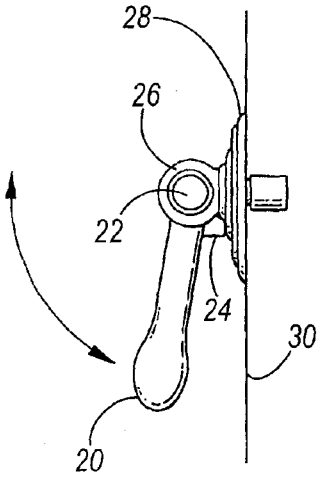
(PRIOR ART) FIG. 2
Figure 3:
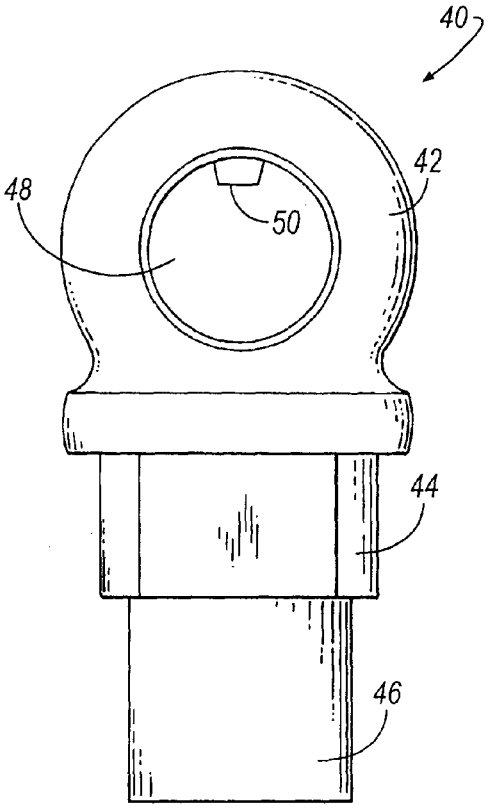
Figure 4:
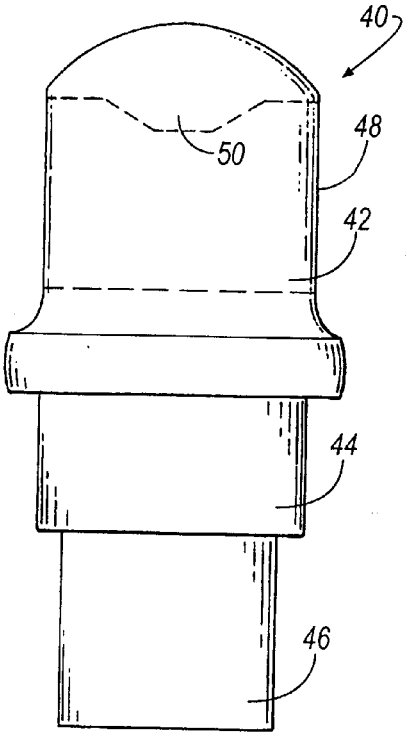
Figure 5:
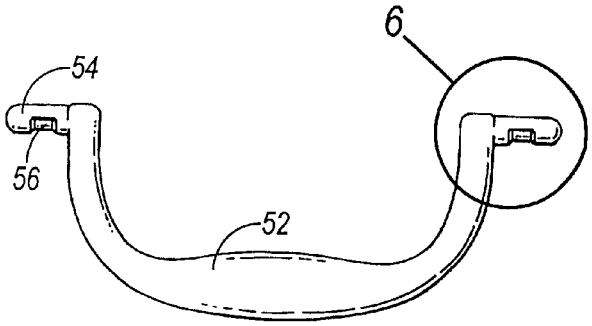
Figure 7:
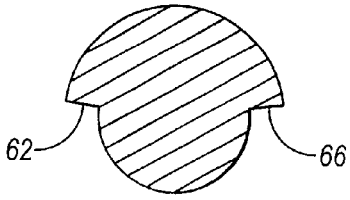
Figure 6:
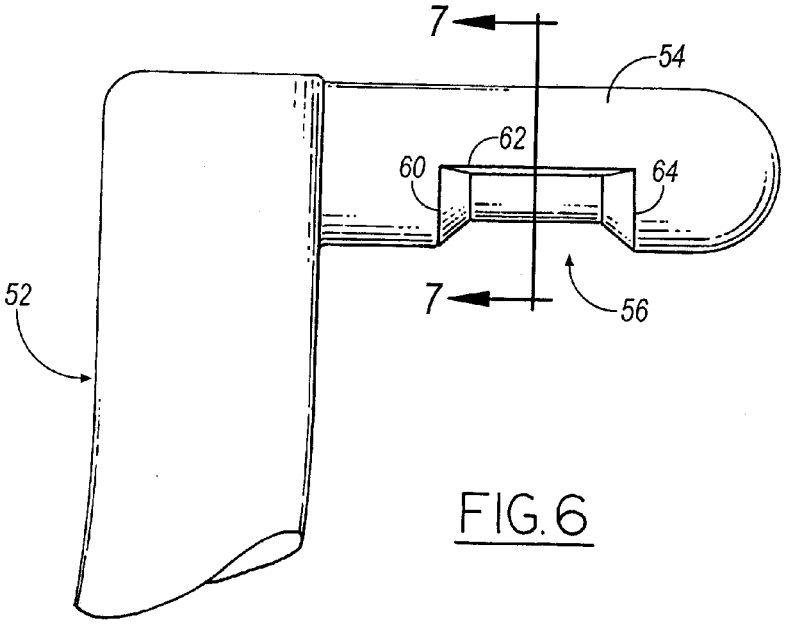
Figure 9:
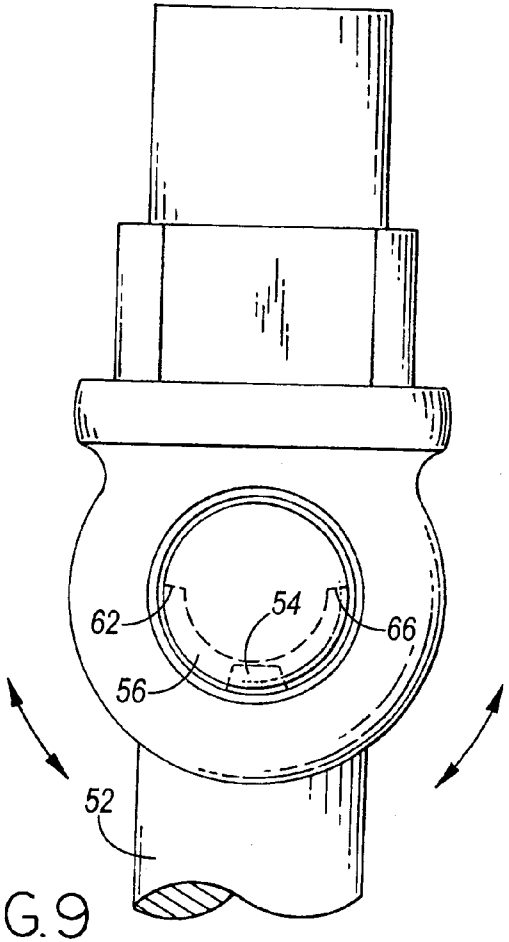
Figure 8:
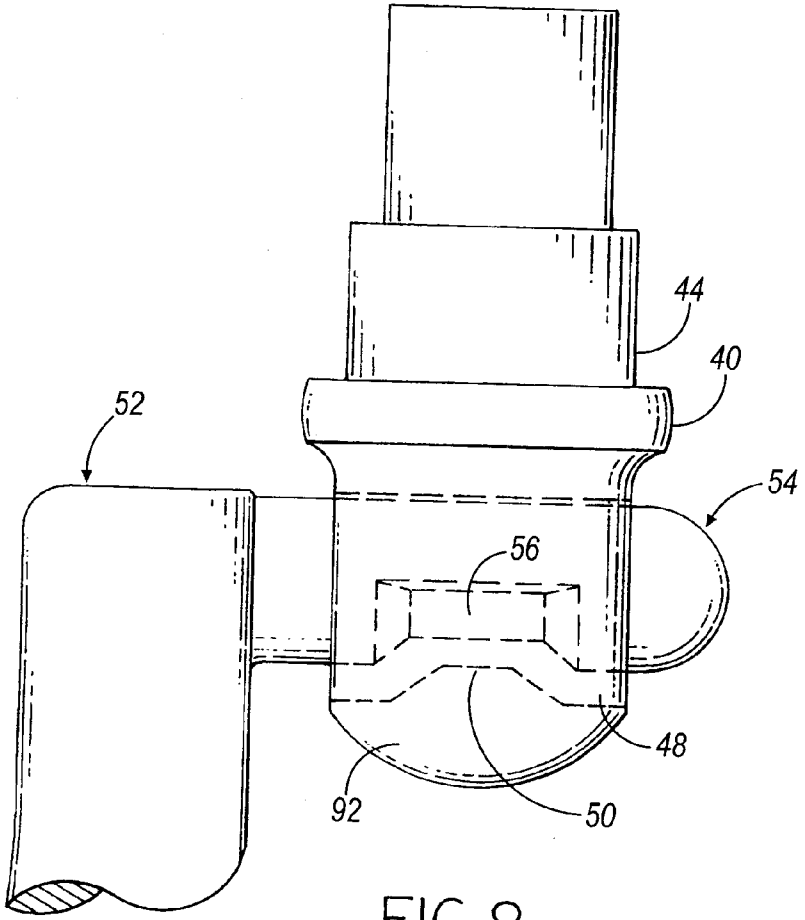
Figure 10:
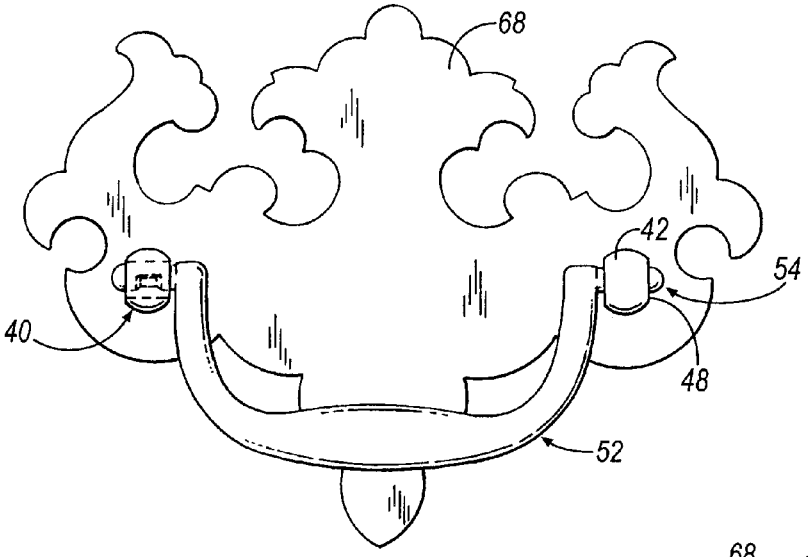
Figure 11:
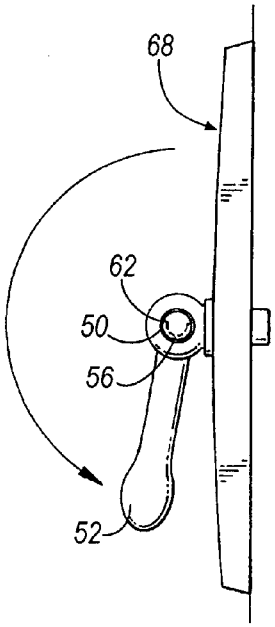
Figure 12:
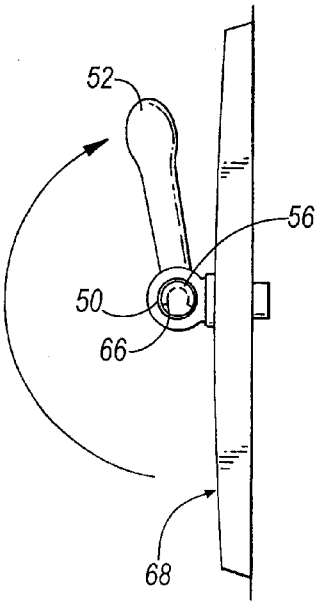

FIGS. 11 and 12 show a stud-bail assembly of the present invention in operation. As shown in FIG. 11, when bail 52 swings downward, boss portion 50 engages side 62 of recessed portion 56 preventing bail 52 from contacting underlying backplate 68 without the need of a stop. Likewise, when bail 52 swings upward as shown in FIG. 12, boss portion 50 engages side 66 of recessed portion 56 again preventing bail 52 from contacting underlying backplate 68.

It is also possible for the studs of the present invention to be used with bails of the prior art and vice versa. Since the clearing between the bottom of opening 48 in stud 40 to the tip of boss portion 50 is wide enough to accommodate a pintle with or without recessed portion 56, bails of the prior art which do not have recessed portion 56 can still be employed. However, since prior art bails do not have a recessed portion on the pintles, a limiting structure cannot be formed. Thus, such assembly would require stops to be formed on the bails to protect the underlying surface. Conversely, bail 52 of the present invention may be coupled with studs of the prior art that lacks boss portion 50. Although studs 40 and bail 52 of the present invention allow for combination with prior art bails and studs, the full advantages of the studbail assembly of the present invention will not be realized as a result.

Having fully described the preferred embodiments of the invention, variations and modifications may be employed without departing from the scope of the present invention. Accordingly, the following claims should be studied to learn the true scope of the present invention.

What is claimed is:

1. A stud-bail assembly comprising:

a bail and two studs, each stud of said two studs comprising a head section, said head section being provided with an opening, said opening having a projecting portion;

said bail comprising two ends, each of said ends being configured as a pintle adapted to be passed through a respective opening of said head section openings;

wherein each of said pintles comprises a closed recessed portion defined by a pair of opposite lengthwise border parts and a pair of opposite border parts thereacross such that when said pintle is forced into said head section opening upon assembling and said head section is mechanically deformed thereupon to rotatably attach said pintle to said stud, a locked stud-bail connection is established and a one-piece stud-bail assembly is formed, said lengthwise border parts serving as stops for said projecting portion, to thereby protect a surface on which said assembly is mounted.

2. An assembly as in claim 1, further comprising an ornamental member, wherein said ornamental member is attached to said studs.

3. An assembly as in claim 2, wherein said ornamental member is a rosette.

4. An assembly as in claim 2, wherein said ornamental member is a backplate.

* * * * *

UNITED STATES PATENT AND TRADEMARK OFFICE

CERTIFICATE OF CORRECTION

PATENT NO. : 5,901,414
DATED : May 11, 1999
INVENTOR(S) : VanHuis et al.

It is certified that error appears in the above-identified patent and that said Letters Patent is hereby corrected as shown below:

The title page showing the illustrative figures should be deleted to be replaced with the attached title page.

Drawings,
Figs. 1-12, should be deleted to be replaced with the corrected Figs. 1-12, as shown on the attached page.

Signed and Sealed this

Third Day of June, 2003

JAMES E. ROGAN
*Director of the United States Patent and Trademark Office*

United States Patent [19]

VanHuis et al.

[11] Patent Number: 5,901,414

[45] Date of Patent: May 11, 1999

[54] STUD-PINTLE ASSEMBLY FOR BAIL STOP

[75] Inventors: David VanHuis, Marne; Kevin Todd Dewald, Spring Lake, both of Mich.

[73] Assignee: Keeler Brass Company, Grand Rapids, Mich.

[21] Appl. No.: 08/946,772

[22] Filed: Oct. 8, 1997

[51] Int. Cl.[6] ..... A47B 95/02

[52] U.S. Cl. ..... 16/126; 16/112

[58] Field of Search ..... 16/126, 112, 125, 16/124, 127

[56] References Cited

U.S. PATENT DOCUMENTS

| | | | |
|---|---|---|---|
| 2,594,027 | 4/1952 | Jakeway | 16/126 |
| 2,701,114 | 2/1955 | Donaldson | 16/126 |
| 3,673,634 | 7/1972 | Van Ryn et al. | 16/126 |
| 3,769,655 | 11/1973 | Cartwright | 16/126 |
| 4,261,077 | 4/1981 | Brock et al. | 16/126 |
| 5,461,755 | 10/1995 | Hardigg et al. | 16/112 |

*Primary Examiner*—Chuck Y. Mah

*Attorney, Agent, or Firm*—Rader, Fishman & Grauer PLLC

[57] ABSTRACT

A stud-bail assembly is made of a bail with pintles each having a recessed portion which mates with studs having boss portions to create a limiting structure to restrict the swinging movement of the bail, thus preventing the bail from damaging the underlying surface of the assembly. Additionally, the stud-bail assembly is formed as a one-piece part to facilitate ease of shipping and handling.

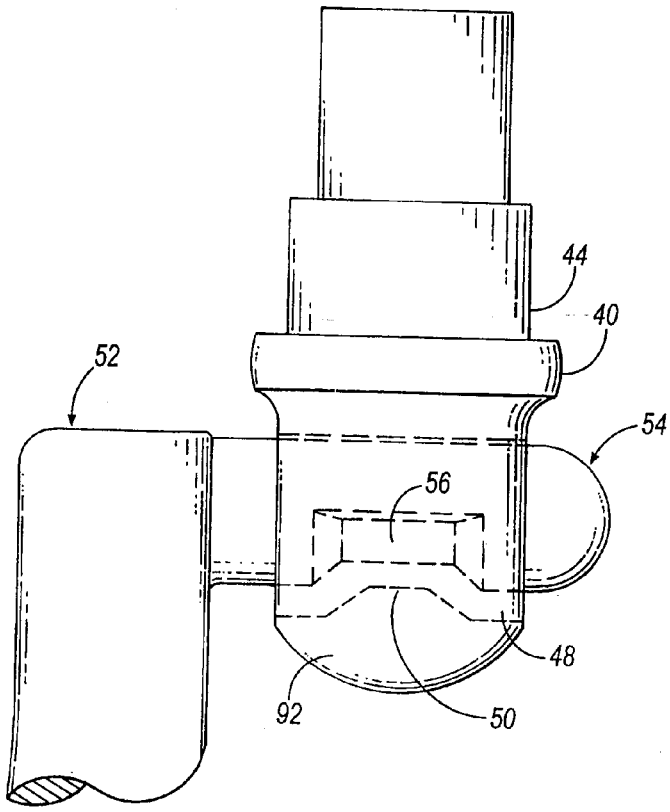

4 Claims, 4 Drawing Sheets